United States Patent [19]

Unrath et al.

[11] Patent Number: 4,471,666

[45] Date of Patent: Sep. 18, 1984

[54] VIBRATORY RAM FOR RAMMING AND/OR DRAWING OF RAMMING MEMBERS

[75] Inventors: Ludwig Unrath, Esslingen-Neckarhalde; Rudolf Hennecke, Remshalden-Buoch, both of Fed. Rep. of Germany

[73] Assignee: Delmag-Maschinenfabrik Reinhold Dornfeld GmbH & Co., Esslingen, Fed. Rep. of Germany

[21] Appl. No.: 466,405

[22] Filed: Feb. 15, 1983

Related U.S. Application Data

[63] Continuation of Ser. No. 171,704, Jul. 24, 1980, abandoned.

[30] Foreign Application Priority Data

Aug. 9, 1979 [DE] Fed. Rep. of Germany ..... 2932287

[51] Int. Cl.[3] ..... B06B 1/18; E02D 7/18

[52] U.S. Cl. ..... 74/61; 173/49

[58] Field of Search ..... 74/61; 173/49

[56] References Cited

U.S. PATENT DOCUMENTS

| | | | |
|---|---|---|---|
| 2,206,386 | 7/1940 | Bernhard | 74/61 |
| 3,208,292 | 9/1965 | Austin | 74/61 |
| 4,113,034 | 9/1978 | Carlson | 173/49 |

FOREIGN PATENT DOCUMENTS

| | | | |
|---|---|---|---|
| 765723 | 3/1934 | France | 74/61 |
| 241986 | 8/1946 | Switzerland | 74/61 |

*Primary Examiner*—Lawrence J. Staab

*Attorney, Agent, or Firm*—Stephenson & Boller

[57] ABSTRACT

A vibratory ram for ramming and/or drawing of ramming members, comprises at least two out-of-balance rotors, at least one motor and at least one transmission which drive the two out-of-balance rotors in synchronism in opposite directions, at least two unbalanced masses on each of said out-of-balance rotors, wherein each out-of-balance rotor has a first unbalanced mass disposed on a first shaft and a second unbalanced mass disposed on a second shaft, said first and second shafts being concentric and being rotatable about their common axis, and a phase adjusting device for altering the relative phase of the first and second shafts.

15 Claims, 5 Drawing Figures

VIBRATORY RAM FOR RAMMING AND/OR DRAWING OF RAMMING MEMBERS

This application is a continuation of application Ser. No. 06/171,704, filed July 24, 1980 now abandoned.

The invention relates to a vibratory ram for ramming and/or drawing of ramming members such as piles, logs, and the like.

Vibratory rams are already known, in which each of the out-of-balance rotors, which can be driven in synchronism in opposite directions, have at least two unbalanced masses which can be driven about the same axis and are angularly adjustable relative to each other.

They offer the advantage of permitting adjustment of the static moment resulting from the effective unbalanced masses so that the penetration resistance of the subsoil and any ramming obstructions disposed therein can be overcome. Furthermore, variability of the static moment permits the natural resonance of the soil to be found so that thereafter the static moment can be reduced so as to avoid undesirable vibrations in the area surrounding the operating region. Furthermore, relative adjustability of the unbalanced masses permits adaptation of the amplitude of the operating procedure.

For example, the amplitude used for ramming is greater than that used for drawing.

In known vibratory rams, one of the unbalance segments, which are non-rotationally mounted serially in pairs on the one shaft of the out-of-balance rotors, must be suitably reset to change the relative angular position in order to increase or reduce the vertical unbalance force of the static moment.

It will be clear that this necessitates toleration of serious disadvantages. For example, it is necessary to interrupt ramming of a pile if the static moment is insufficient to overcome the penetration resistance offered by the subsoil.

In this case it is necessary for the vibratory ram to be removed from the pile and to be lowered and thereafter the guards covering the unbalanced segments must be removed, the unbalanced segments which are to be adjusted must be removed from the shafts of the out-of-balance rotors and must be replaced thereon in a correspondingly changed angular position and thereafter must be secured. Thereafter, it is necessary for the previously described steps to be repeated in the reverse sense. Finally, the frequency of the unbalance must be suitably changed. It was hardly possible for these operations to be completed in a time of less than 2 hours According to the invention, a vibratory ram for ramming and/or drawing of ramming members such as piles logs, and the like comprises at least two out-of-balance rotors and at least one motor and at least one transmission, which drive in synchronism in opposite directions the two out-of-balance rotors, at least two unbalanced masses on each of said out-of-balance rotors and means for driving the at least two unbalanced masses, whereby each out-of-balance rotor has a first unbalanced mass disposed on a first shaft and a second unbalanced mass disposed on a second shaft, each shaft being concentric relative to each other and having the same common axis, and a phase adjusting device being provided for altering the phase of the first shaft relative to the second shaft.

The static movement of the vibratory ram according to the invention can therefore be steplessly varied by remote control during ramming or drawing from zero to a maximum value.

The invention thus avoids all downtimes arising from the use of the vibratory ram and permits exceptionally sensitive adaptation of the static moment to the nature of the soil and of the ramming member.

Thus, the static moment can be changed without stopping the vibratory ram and without the need to perform manual operations thereon.

The invention provides a wide range of embodiments for the phase adjusting device. It will be obvious, that the phase adjusting device also enables both shafts associated with each out-of-balance rotor and supporting the unbalanced masses to be jointly rotated in opposite directions.

In one preferred embodiment of the vibratory ram according to the invention, that phase adjustment device is partially integrated with the transmission. To this end, the shafts, which support the unbalanced masses and are associated with the out-of-balance rotors, can be arranged serially and coaxially. The construction which permits the unbalanced masses to be multiplied in a very small space is that the two shafts, which are supported one within the other, can be constructed as hollow shafts.

By virtue of the shafts being disposed one within the other it is therefore possible for unbalanced masses, which are adjustable relative to each other, to be arranged so that they move on directly adjacently disposed circular tracks. It is thus possible to provide two pairs of shafts, one supported within the other, and supporting unbalanced masses to be arranged coaxially with respect to each other.

In a preferred embodiment of the vibratory ram, a phase adjusting device can form a planetary transmission having a planet gear, and a gearing, which is associated with the first shaft and forms a sunwheel, the gearing being in mesh with the planet gear, the planet gear forming the driving gear of said first shaft, and in which the phase adjusting device comprises means for adjusting the planet gear along a circle which is concentric with said first shaft.

The phase adjusting device is partially integrated with the transmission. A common drive can be provided for all shafts which support unbalanced masses. The drive comprises a transmission wheel, which drives the planet wheel via a bypass transmission. The transmission wheel also drives the second shaft of the out-of-balance rotors.

In another preferred embodiment a vibratory ram comprises intermediate gear wheels which drive the planet gear, a support member which at least partially supports the intermediate gear wheels, two pivotable levers having the support member provided between them, the support member being hinged to the two rocker levers, one of the two levers being pivoted about the common axis of the first and second shafts, and the second of the two levers being pivoted about the axis of said transmission wheel which axis is parallel with the said common axis, and an adjusting device which can steplessly pivot one of the two levers between two limiting positions.

In another preferred embodiment a vibratory ram in which the planet wheel and the intermediate gear wheel of the bypass transmission are supported by respective ones of the two pivotable levers, and two further said intermediate gear wheels, disposed between and in mesh with the aforementioned planet wheel and intermediate gear wheel, are supported by the support member, and the said planet wheel and intermediate gear wheels have bearing points which define the corner points of a trapezium.

With this concept of a transmission it is possible to vary the static moment by the linear control motion of a final control element associated with the adjusting device so that the latter can be constructed with the greatest simplicity and can be accommodated in space-saving manner in the case of the vibratory ram.

The invention will now be explained by way of example with reference to the accompanying drawings, in which FIG. 1 shows a front view of a bottom gear train of a vibrator of a vibratory ram according to the invention;

Figure 1:
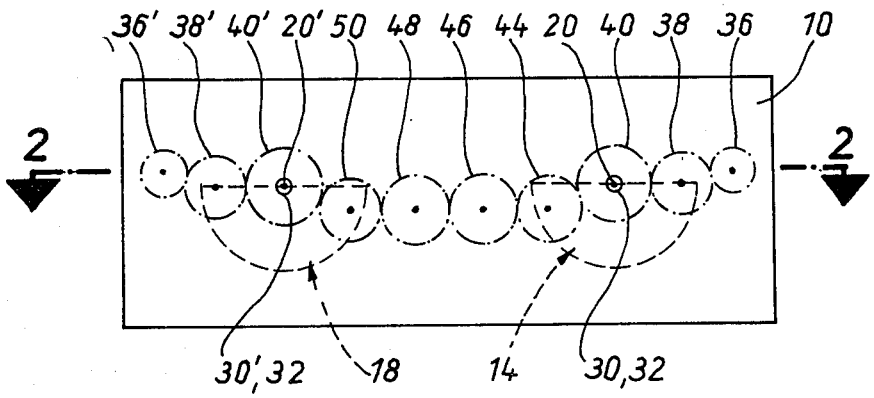
Figure 2:
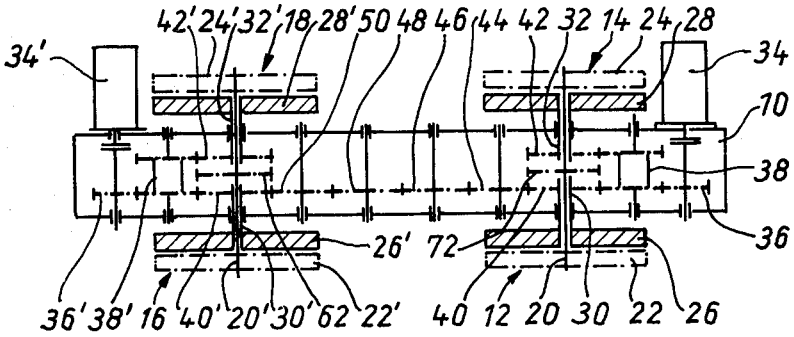
FIG. 2 is a section through the vibrator along the line 2—2 of FIG. 1.

The vibrator shown in the drawings forms part of a vibratory ram and is resiliently suspended from the underside of the spring yoke of the vibratory ram. The arrangement of a vibratory ram with a spring yoke and a vibrator suspended therefrom is known and does not form any part of the invention.

The invention relates to the vibrator construction which permits the static moment produced by the out-of-balance rotors to be steplessly varied from zero to a maximum value while the vibratory ram is in use.

The gear casing, shown as a block-shaped member in the drawing, is designated with the numeral 10. A total of four out-of-balance rotors 12, 14, 16, 18 are rotatably supported in the casing. The out-of-balance rotors are arranged in pairs, axially parallel with each other.

Associated rotor pairs are arranged approximately symmetrically with respect to the longitudinal centre line of the gear casing and each has a common inner shaft 20 or 20' which extends transversly through the gear casing. An unbalanced mass 22 or 24; 22' or 24' is mounted on each of the shaft ends which are disposed outside the gear casing. The unbalanced masses have the shape of semi-circular segments. They can also have other shapes. A second unbalanced mass, also of circular segmental shape is co-ordinated with each of the unbalanced masses and adjacent thereto. The second unbalanced masses are designated with the numerals 26, 28 or 26', 28'. Associated pairs of these unbalanced masses are located on separate hollow shafts 30, 32 or 30', 32', which are arranged coaxially with respect to each other on the inner shafts 20, 20'.

Each out-of-balance rotor therefore has three shafts, namely the inner shaft as well as the two outer shafts which are supported on said inner shaft. Correspondingly shafts of both out-of-balance rotors are jointly driven by a gear train and the total of three shafts of each out-of-balance rotor rotate in the same direction, but opposite to the direction of the shafts associated with the second out-of-balance rotor.

The gear train shown in FIG. 1 drives the outer hollow shafts 30, 32; 30', 32' of the out-of-balance rotors. The drive is transmitted by two prime movers 34, 34', more particularly hydraulic motors, which are situated on a common longitudinal wall of the gear casing 10 at the same distance from the transverse centre thereof. Each of a drive transmission wheel 38 or 38', constructed as a double gear wheel, can be driven by a driving wheel 36 or 36', which is axially parallel with the out-of-balance rotors. The two gear rims of each of the drive transmission wheels mesh with a gear rim 40 or 42; 40' or 42' of the hollow shafts 30, 32 or 30', 32', which are associated with the out-of-balance rotors adjacent to the drive transmission wheels.

The gear rings 40 and 40' of the hollow shafts 30, 30' mesh with intermediate wheels 44, 46, 48, 50, which are mutually in mesh with each other, in order to ensure absolute synchronism of the hollow shafts which are driven in this manner.

Figure 3:
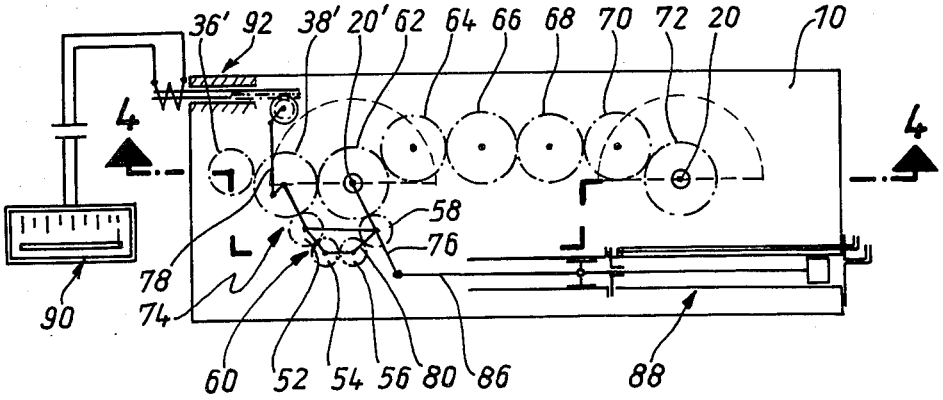
FIG. 3 shows a front view of a top gear train of a vibrator of a vibratory ram according to the invention.
Figure 4:
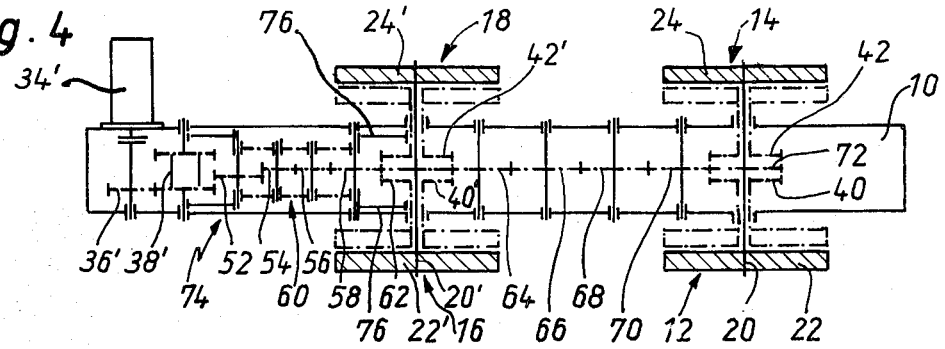
FIG. 4 is a section through the vibrator along the line 4—4 of FIG. 3.

The drive for the inner shafts 20, 20' which are common to the out-of-balance rotors, co-ordinated to each other coaxially in pairs, is obtained by a top gear train shown in FIGS. 3 and 4. To this end, the drive transmission wheel 38' meshes not only with the gear rings 40', 42' but also, via the intermediate wheels 52, 54, 56, 58 of a bypass transmission 60, with a gear rim 62 of the inner shaft 20' of the out-of-balance rotor 16.

The inner shaft 20 of the out-of-balance rotors 12,14 is also driven by the top gear train comprising intermediate wheels 64,66,68 and 70 and as shown in FIG. 3, namely by a gear rim 72 of the inner shaft meshes with the intermediate wheel 70 of the top gear train.

The bottom and top gear trains are designed so that, as already explained, all shafts of the out-of-balance rotors 12, 14 as well as 16, 18, associated with each other in pairs, have the same direction of rotation, but that the out-of-balance rotors are driven in directions opposite to each other. The unbalanced masses of rotor pairs disposed opposite each other are adjusted with respect to each other so that in the course of their rotation the horizontal components of the centrifugal forces generated thereby cancel each other, so that the vibratory ram vibrates only in the vertical direction.

In combination with a lever transmission, the bypass transmission 60 forms a phase adjustment device 74, by means of which the phase of the mutually coordinated unbalanced masses of all out-of-balance rotors can be simultaneously varied during operation of the vibrator for the purpose of steplessly varying the static moment.

The construction of the phase adjusting device 74 will be described in detail with reference to FIG. 5.

To change the phase of the unbalanced masses, the bypass transmission in its entirety can be adjusted relative to the drive transmission wheel 38' and relative to the gear rim 62 of the inner shaft 20' associated with the rotors 16,18, so that the gear wheels 52 and 58 thereof remain in constant mesh with the drive transmission wheel 38' of the gear rim 62 while the transmission is displaced.

To this end a first pivotable lever 76 is pivotably supported on the outer hollow shafts 30', 32' of the out-of-balance rotors 16,18 and a second pivotable lever 78 is pivotably supported on the bearing shaft of the drive transmission wheel 38'. A support member 80 is pivotably hinged on the two pivoting levers therebetween and the two intermediate wheels 54, 56 of the bypass transmission 16 are supported on the support members. The intermediate wheels 52 and 58 of the bypass transmission are supported at the places 82; 84 at which the support member is pivoted to the pivotable levers. As shown in FIG. 5, the relative arrangement of the intermediate wheels 52 to 58 is such that the bearing points of all these wheels form the corners of a trapezium. A control member 86 of an adjusting device 88 shown in FIG. 3 in the bottom casing part, is pivoted on the pivotable lever 76. The adjusting device preferably comprises a cylinder piston unit whose piston rod forms the control element.

Figure 5:
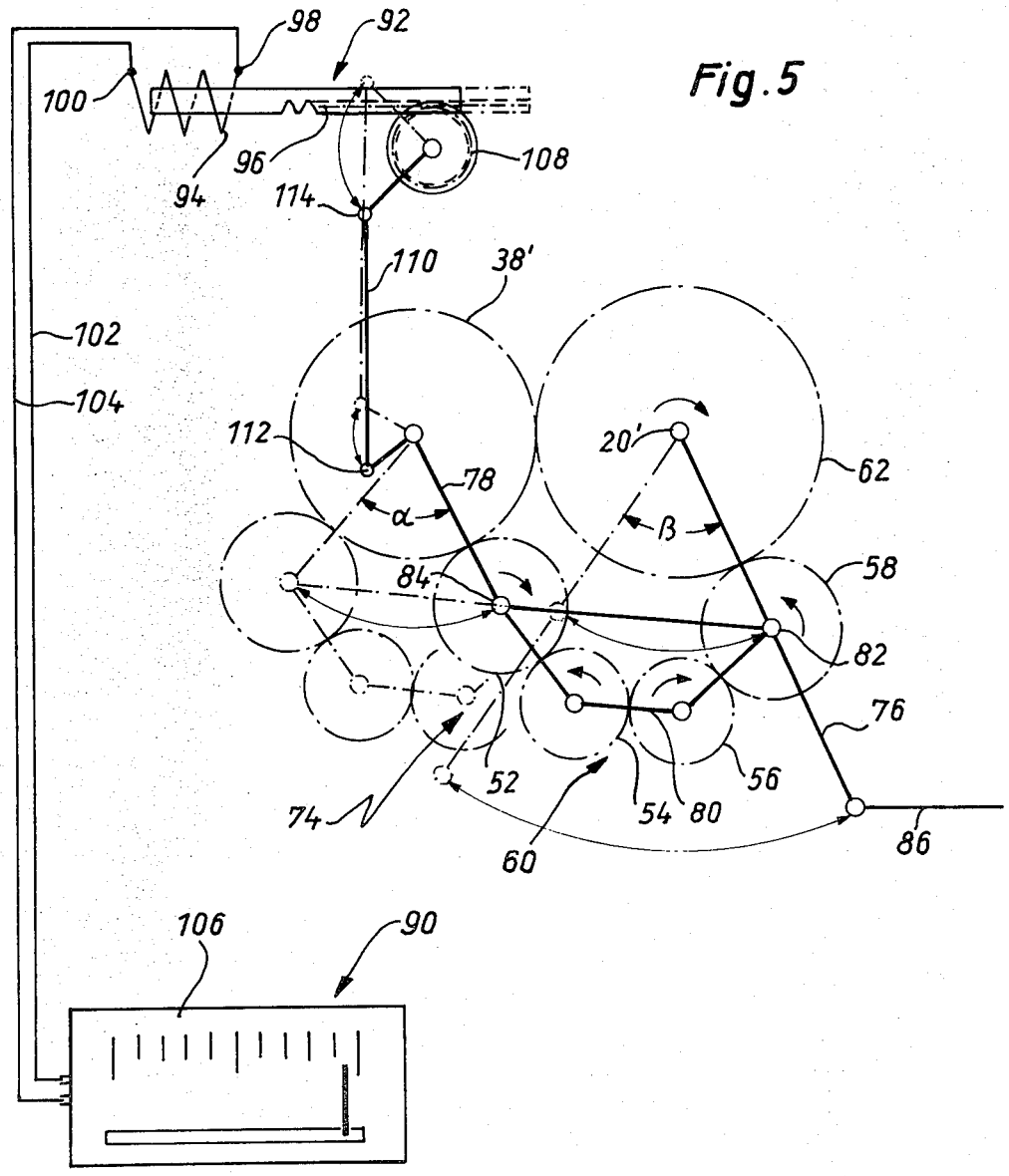
FIG. 5 is an enlarged view of a part of FIG. 3.

As can be seen with reference to FIG. 5, the rocker comprising the pivotable levers 76, 78 and the support member 80 can be pivoted about the maximum angle $\alpha$. To this end, it may be assumed that, in the illustrated starting position of the pivotable lever, the static moment produced by rotation of the out-of-balance rotors is zero, since the two unbalanced masses of each out-of-balance rotor are situated opposite to each other at an angular distance of 180°. This 180° phase position of the unbalanced masses is varied by pivoting of the pivotable lever, so that the gear rim 62 and the intermediate wheel 58 as well as the drive transmission wheel 38' and the intermediate wheel 52 form panetary transmissions and the transmission wheel 38' and the gear rim 62 function as sunwheels while intermediate wheels 52 and 58 function as planet wheels.

The number of teeth of the wheel 38' and the gear rim 62 associated with the internal shaft 20', as well as the planet wheels 52 or 58 meshing therewith, are so adapted to each other that on traversing through the maximum pivoting angle $\alpha$, the unbalanced masses disposed on the inner shafts 20, 20' are pivoted through 180° relative to the unbalanced masses co-ordinated therewith and as a result of the change of phase which then takes place, the unbalances can be steplessly increased to a maximum value.

To understand the change of phase of the unbalanced masses in the course of pivoting of the pivotable lever it is necessary to regard the drive transmission wheel 38' as a stationary wheel. As the pivotable lever pivots, two relative motions of the planet wheel 52 take place; on traversing through the angle $\alpha$, this wheel performs two motions which are superimposed upon each other, namely an absolute rotation and furthermore, as a result of rolling, a relative rotating motion. The absolute rotation in this case results from the pivoting angle $\alpha$. This rotating motion is transmitted via the intermediate wheels, by counter-rotation, to the intermediate wheel 58 which forms a planet wheel. Since the latter can drive the inner shafts 20,20', the wheel 58 does not perform the absolute rotation explained in relation to the wheel 52; instead, the angle of rotation resulting in the wheel 52 from absoulte and relative rotation is imposed on the wheel 58 and finally, the maximum traversed angle $\beta$ resulting from the differing lever lengths of the pivotable lever 76, rotation of the gear wheel 62 and therefore of the inner shafts 20, 20' is performed and this rotation can be arranged so that it corresponds to an angle of rotation of 180°.

The formula for determining the phase position of the unbalanced masses is shown below:

$$\gamma^o = \alpha^o\left(1 + \frac{Z(\text{wheel } 38')}{Z(\text{wheel } 52)}\right)\frac{Z(\text{wheel } 58)}{Z(\text{wheel } 62)} + \beta^o\left(\frac{1 + Z(\text{wheel } 58)}{Z(\text{wheel } 62)}\right)$$

The vibratory ram is equipped with an indicating device 90, by means of which the preset static moment is indicated. The device comprises, for example, an inductive transducer 92 in whose stationary coil 94 a core, formed by the end piece of a gear rack 92, is guided in an axially adjustable manner. Electric conductors 102, 104 extend from terminals 98, 100 of the coil 94 to an incicating instrument 106. The core of the coil is displaced relative to the coil by a gear wheel 108 which meshes the gear rack 96 in accordance with the pivoting motion performed by the pivotable levers 76, 78 and the rotation of the gear wheel is performed by means of cams 112, 114. These are coupled by means of an adjusting rod and of which the cam 112 can be pivoted about the pivoting axis of the pivotable lever 78, but is rigidly connected thereto and the cam 114 can be pivoted about the axis of rotation of the gear wheel 38' and is rigidly connected thereto.

Displacement of the core results in a change of inductance or mutual coupling thus producing a signal voltage which can be evaluated and converted into a d.c. voltage. It is obvious that the electrical components of the indicating device for producing the signal voltage can also be embodied by means of different solutions.

It is also clear that the out-of-balance rotors of the vibratory ram could be driven by a prime mover and that in its simplest embodiment the vibratory ram could comprise merely one out-of-balance rotor with an inner and an outer shaft, each supporting an unbalanced mass and a phase adjusting device co-ordinated therewith.

We claim:

1. A vibratory ram for ramming and/or drawing of piles, planks or the like, comprising at least two contra-rotating rotor systems arranged side-by-side and being synchronously drivable by at least one motor, a gear system operatively coupling said rotor systems together and with such at least one motor, each of said rotor systems comprising at least a first and a second unbalanced mass mounted on separate shafts arranged perpendicular to the vibration direction of the ram, and said gear system comprising a phase control device for altering the relative phase of said first and second unbalanced masses, characterized in that said gear system has a first gear train for synchronizing and driving contra-rotating first unbalanced masses of said rotor systems and at least a second gear train for synchronizing and driving contra-rotating second unbalanced masses of said rotor systems and being coupled with said first gear train, and for altering said relative phase the phase control device comprises a planetary transmission via which the first unbalanced masses of the rotor systems are coupled to the second unbalanced masses and which has first and second pivotable planet pinion carriers carrying first and second planet pinions, said first planet pinion meshing with a particular gear wheel of the first gear train, the second planet pinion meshing with a particular gear wheel of the second gear train, and that the pivot axes of said planet pinion carriers are aligned with the axes of said particular gear wheels and parallel to each other and to the axes of said planet pinions.

2. Ram as claimed in claim 1, characterized in that the two planet pinions are mounted for rotation on a common planet pinion carrier which is pivotable around the axes of said two particular gear wheels such that the latter are continuously meshing with said planet pinions.

3. Ram as claimed in claim 1, characterized in that a cylinder-piston-unit is provided for pivoting said planet pinion carrier, the axis of said cylinder-piston-unit being in a plane perpendicular to the axes of certain ones of said shafts of said rotor systems and also being parallel to a plane containing the axes of said certain ones of said shafts.

4. Ram as claimed in claim 1, characterized in that an indicating device for indicating the effective static moment is coupled with the planet pinion carrier.

5. Ram as claimed in claim 1, characterized in that the shafts of said first unbalanced masses are in the form of hollow shafts disposed on the shafts of the second unbalanced masses.

6. Ram as claimed in claim 1, characterized in that said shafts of said rotor systems are also disposed in a common plane.

7. Ram as claimed in claim 1 characterized in that said planet pinions are in reverse rotational drive connection with each other.

8. A vibratory ram for ramming and/or drawing of ramming members, comprising at least two out-of-balance rotors, at least one motor and at least one transmission which drive the two out-of-balance rotors, in synchronism in opposite directions, at least two unbalanced masses on each of said out-of-balance rotors, wherein each out-of-balance rotor has a first unbalanced mass disposed on a first shaft and a second unbalanced mass disposed on a second shaft, said first and second shafts of each out-of-balance rotor being concentric and being rotatable about their common axis, and a phase adjusting device for altering the relative phase of the first and second shafts;

in which the second shaft of each out-of-balance rotor is a hollow shaft, and is supported by the first shaft; and comprising a planetary transmission portion having a planet gear, and a gearing, which is associated with one of the first shafts and forms a sunwheel, the gearing being in mesh with the planet gear, the planet gear forming the driving gear of said one first shaft, and in which the phase adjusting device comprises means for adjusting the planet gear along a circle which is concentric with said one first shaft;

a transmission wheel driven by said at least one motor, said transmission wheel driving the second shafts of the out-of-balance rotors;

a bypass transmission portion for driving the planet gear by the transmission wheel comprising intermediate gear wheels which drive the planet wheel, a support member which at least partially supports the intermediate gear wheels, two pivotable levers having the support member provided between them, the support member being hinged to said two pivotable levers, one of the two levers being pivoted about the common axis of said one first shaft and the corresponding second shaft, and the second of the two levers being pivoted about the axis of said transmission wheel, which latter axis is parallel with the said common axis of said one first shaft and the corresponding second shaft, and an adjusting device which can steplessly pivot one of the two levers between two limiting positions.

9. A vibratory ram according to claim 8 comprising a cylinder-piston unit having a piston rod, which rod is pivoted to one of the pivotable levers for adjusting the pivot position of said levers.

10. A vibratory ram according to claim 8 in which the pivotable levers have a maximum pivoting angle which corresponds to a relative rotation of the first shafts through 180° relative to each other.

11. A vibratory ram according to claim 8 comprising an indicating device for indicating the effective static moment.

12. A vibratory ram according to claim 8, in which the bypass transmission includes a first intermediate gear wheel, and the planet wheel and said first intermediate gear wheel of the bypass transmission are supported by respective ones of the two pivotable levers, and further including two more intermediate gear wheels, disposed between and in mesh with the aforementioned planet wheel and first-mentioned intermediate gear wheel, said two more intermediate gear wheels are supported by the support member, and the said planet wheel and the three intermediate gear wheels have bearing points which define the corner points of a trapezium.

13. A vibratory ram according to claim 12 comprising a cylinder-piston unit having a piston rod, which rod is pivoted to one of the pivotable levers for adjusting the pivot position of said levers.

14. A vibratory ram according to claim 12 in which the pivotable levers have a maximum pivoting angle which corresponds to a relative rotation of the first shafts through 180° relative to each other.

15. A vibratory ram according to claim 12 comprising an indicating device for indicating the effective static moment.

* * * * *